United States Patent [19]

Mills

[11] Patent Number: 5,048,475

[45] Date of Patent: Sep. 17, 1991

[54] ROCKER ARM

[75] Inventor: Jesse V. Mills, Toledo, Ohio

[73] Assignee: Henley Manufacturing Holding Company, Inc., Hampton, N.H.

[21] Appl. No.: 642,645

[22] Filed: Jan. 17, 1991

[51] Int. Cl.[5] ..... F01L 1/18

[52] U.S. Cl. ..... 123/90.39; 123/90.41; 74/519; 74/559

[58] Field of Search ..... 123/90.39.90.41, 90.42, 123/90.44; 74/519, 559

[56] References Cited

U.S. PATENT DOCUMENTS

| | | | |
|---|---|---|---|
| 4,697,473 | 10/1987 | Patel | 123/90.39 |
| 4,738,231 | 4/1988 | Patel et al. | 123/90.39 |
| 4,796,483 | 1/1984 | Patel et al. | 123/90.39 |
| 4,799,464 | 1/1989 | Patel et al. | 123/90.41 |
| 4,825,717 | 5/1989 | Mills | 123/90.39 |
| 4,829,647 | 5/1989 | Anderson et al. | 123/90.39 |
| 4,848,180 | 7/1989 | Mills | 123/90.39 |
| 4,940,048 | 7/1990 | Mills | 123/90.39 |
| 4,979,475 | 12/1990 | Mills | 123/90.39 |

*Primary Examiner*—David A. Okonsky
*Assistant Examiner*—Weilun Lo
*Attorney, Agent, or Firm*—Allen D. Gutchess, Jr.

[57] ABSTRACT

A rocker arm has a one-piece metal body made by cold-forming operations, including staming, extruding, coining, and back-packing. The rocker arm includes an intermediate portion and two end portions. The intermediate portion has substantially parallel side walls with a large, generally rectangular opening at the top and with two end top walls extending sharply downwardly therefrom. The parallel side walls are deep and both the side walls and top walls are thinner at upper portions than at lower portions. A first end portion of the body has a wide top wall with arcuate side walls. A method of making the rocker arm includes forming a metal blank with a U-shaped cross section having a convex central portion. A slot is formed in the central portion and that portion is then pushed out or extruded to form the large, generally rectangular opening.

9 Claims, 3 Drawing Sheets

ROCKER ARM

This invention relates to a rocker arm of the cam-follower type having a one-piece, cold-formed body.

The rocker arm in accordance with the invention is of the cam-follower type having a one-piece metal body made by cold-forming operations, including stamping, extruding, coining, and back-packing. The metal body of the rocker arm is elongate and of generally inverted U-shaped cross section throughout most of its length with top wall portion and structurally-integral side walls depending therefrom. The rocker arm includes an intermediate portion and two end portions. The intermediate portion has substantially parallel side walls with a large, generally rectangular opening at the top and with two short, end top walls extending sharply downwardly therefrom.

A first end portion of the body has a wide top wall which is structurally-integral with the lower end of one of the aforesaid two top walls and has two short side walls extending downwardly from side edges thereof. The side walls are of arcuate configuration as viewed from below the body in order to clear the body of a lifter of an engine with which the rocker arm is used. A central portion of the top wall of the first end portion of the rocker arm body has a downwardly-facing recess therein with an opening extending upwardly to receive a rounded end of a lifter post.

The second end portion of the rocker arm body also has a top wall which is structurally integral with a lower end of the other of the two top walls of the intermediate portion. The second end portion also has two side walls extending downwardly therefrom with the lower surface of the second end top wall being engagable with an upper end of a valve stem. The parallel side walls of the intermediate portion of the body have aligned holes therein with an axle received therethrough and a roller rotatably mounted thereon for engaging an overhead cam.

The intermediate portion of the rocker arm body is extruded or pushed out after an elongate slot is formed in a partially formed body to produce the large rectangular opening thereof in one step. The extrusion technique enables the two top walls at the ends of the opening of the intermediate portion to be at much steeper angles than when made with conventional stamping operations. The steeper angles enable the rocker arm to be more compact and shorter than otherwise possible. This is an important consideration in smaller engines and those involving multiple valves and multiple rocker arms per cylinder.

With the extrusion technique, the parallel side walls of the intermediate portion of the rocker arm can also be deeper, as measured from top to bottom, than corresponding side walls of similar rocker arms heretofore known. This enables the rocker arm to be stronger and stiffer. The side walls also taper from the bottom toward the top, although the upper edges may be slightly thickened and squared by a subsequent back-packing step.

It is, therefore, a principal object of the invention to provide a rocker arm of the cam-follower type having a one-piece, cold-formed body with intermediate top walls extending at sharper angles and with deeper, tapered side walls at an intermediate portion thereof.

Another object of the invention is to provide a rocker arm of the cam-follower type with a one-piece, cold-formed body having the advantages and features discussed above.

Other objects and advantages of the invention will be apparent from the following detailed description of a preferred embodiment thereof, reference being made to the accompanying drawings, in which.

Figure 1:
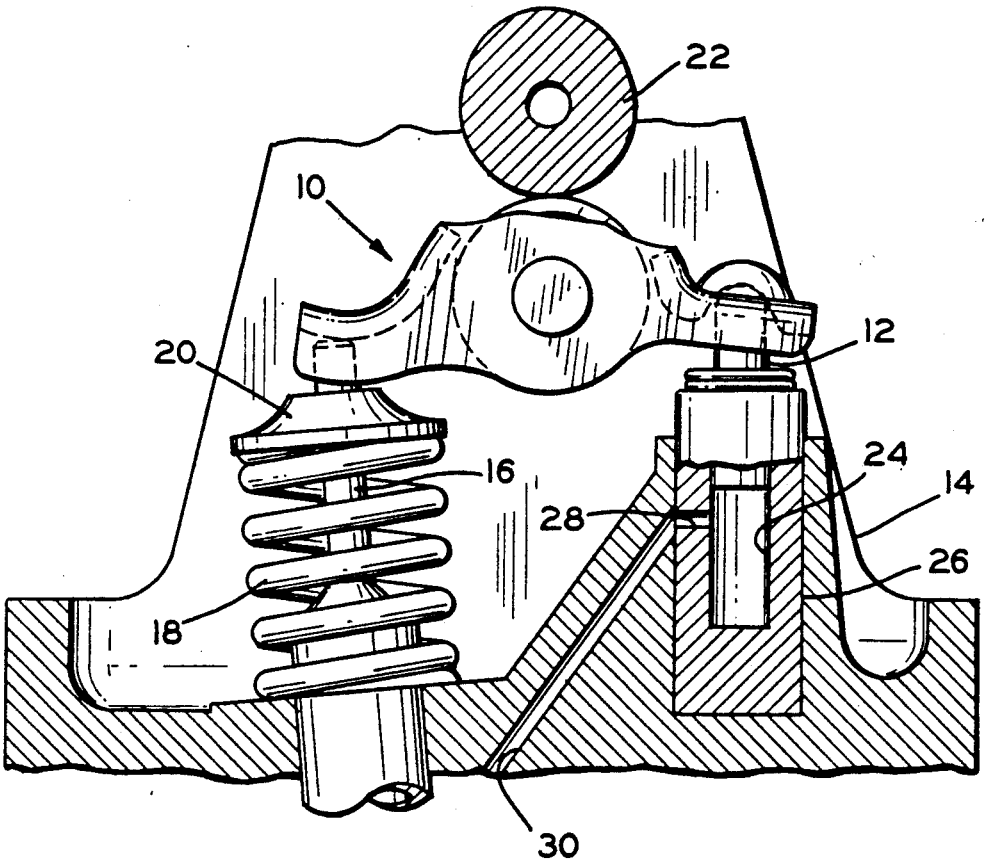
FIG. 1 is a somewhat schematic view in cross section, with parts in elevation, of valve-actuating mechanism including a rocker arm in accordance with the invention.
Figure 2:
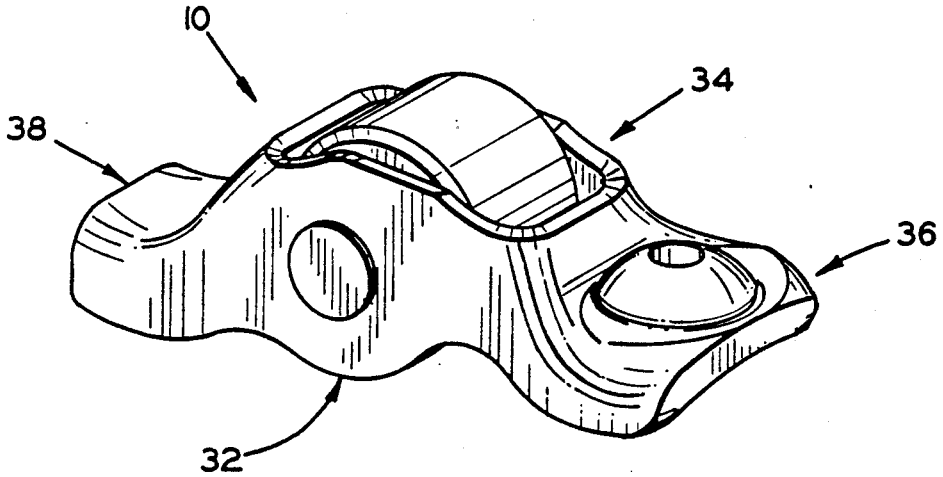
FIG. 2 is a view in perspective of the rocker arm of FIG. 1.
Figure 3:
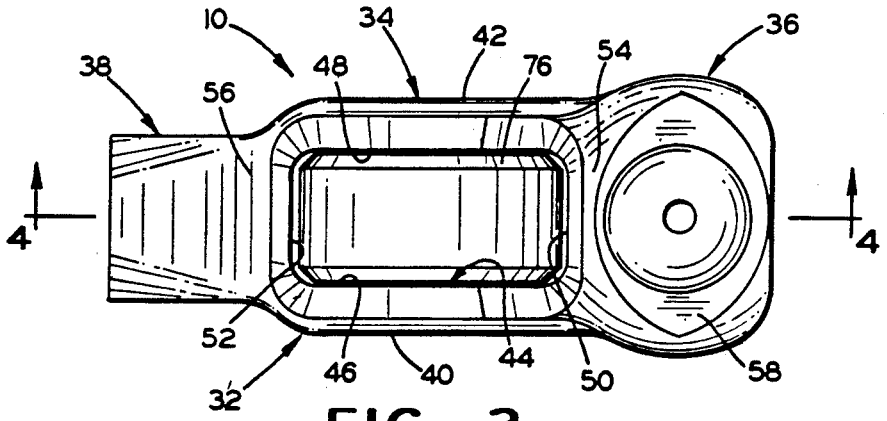
FIG. 3 is a top view of the rocker arm of FIG. 2.
Figure 4:
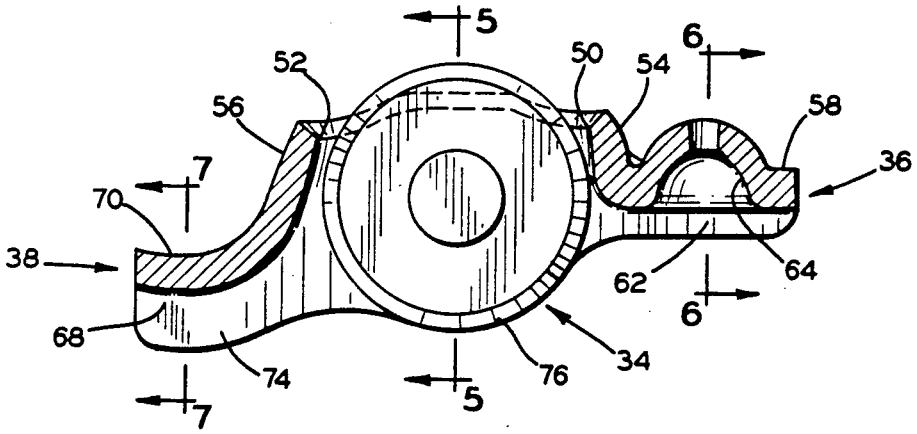
FIG. 4 is a view in longitudinal cross section taken along the line 4—4 of FIG. 3.
Figure 5:
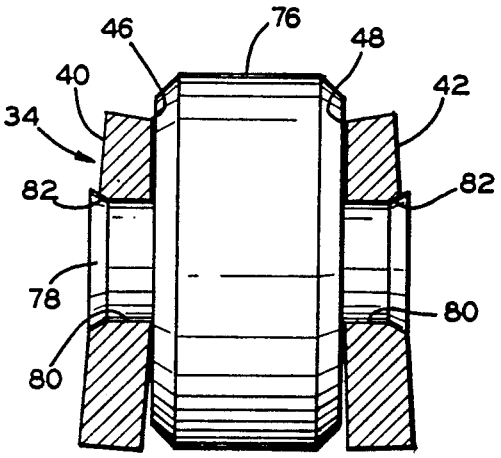
FIG. 5 is a view in transverse cross section of an intermediate portion of the rocker arm taken along line 5—5 of FIG. 4.
Figure 6:
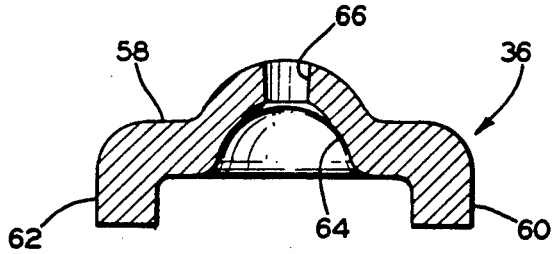
FIG. 6 is a view in transverse cross section taken along the line 6—6 of FIG. 4.
Figure 7:
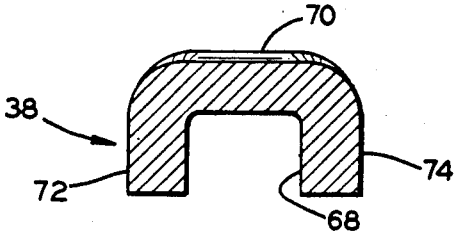
FIG. 7 is a view in transverse cross section taken along the line 7—7 of FIG. 4.

Referring particularly to FIGS. 1 and 2, a rocker arm of the cam-follower type is indicated at 10 and has one end portion received on a rocker arm fulcrum or lifter post 12 extending upwardly from a cylinder head 14 of an internal combustion engine. A second end portion of the rocker arm engages an upper end of a valve stem 16. The valve stem extends upwardly from the cylinder head through a coiled compression spring 18 located therearound and which is seated against the cylinder head and against a retainer ring 20 mounted on the valve stem 16. An overhead cam 22 engages an intermediate portion of the rocker arm 10 to cause a valve (not shown) located at the lower end of the valve stem 16 to open and close as the stem is moved longitudinally by the rocker arm 10 as it is caused to pivot by the cam.

The lifter post 12 is slidably carried in a chamber 24 of a cylinder 26. The post is urged upwardly by oil under pressure in the chamber 24 which is supplied through a small port 28 from a supply passage 30. The post 12 can yield somewhat when the cam 22 rotates, with the post moving downwardly slightly at the high lobe of the cam 22 to provide a zero lash adjustment for the rocker arm. The port 28 is of a size to provide for controlled leakage of the oil from the chamber 24 to control the oil pressure therein. Oil can also be supplied from the passage 30 through a passage in the lifter post 12 (not shown) and up to the rocker arm 10 for lubricating purposes.

Referring more particularly to FIGS. 2–7, the rocker arm 10 includes a one-piece, cold-formed metal body 32 which is preferably made by cold-forming operations, including stamping, extruding, coining, and back-packing. The rocker arm body includes an intermediate portion 34, a first end portion 36, and a second end portion 38.

The intermediate portion 34 of the rocker arm body has two substantially parallel side walls 40 and 42 (FIGS. 3 and 5) which are thicker at lower portions and taper to thinner upper portions, although the upper edges may be slightly thickened by a back-packing operation. The taper is shown somewhat exaggerated. The taper of the side walls is formed by an extrusion technique to be discussed subsequently. The extrusion technique also enables the side walls 40 and 42 to be deeper, as measured from top to bottom, than side walls of similar rocker arms heretofore known.

The intermediate portion 34 also has a large, generally rectangular opening 44 with substantially straight, parallel side edges 46 and 48 located at the upper edges of the side walls 40 and 42, and with slightly rounded end edges 50 and 52. The intermediate portion 34 also has end upper or top walls 54 and 56 extending sharply downwardly at steep angles from the end edges 50 and 52 of the opening 44. The top walls 54 and 56 form angles of sixty to eighty degrees with the horizontal, as viewed in FIG. 4. These angles can be much steeper than heretofore found in similar rocker arms of the prior art because of the extrusion technique in forming the intermediate portion, as will be discussed subsequently. Consequently, the overall rocker arm 10 can be shorter and more compact than those heretofore known. The compactness is particularly important for smaller engines and for engines employing multiple valves per cylinder.

The first end portion 36 of the rocker arm body 34 has an upper or top wall 58 and two downwardly-extending side walls 60 and 62. The top wall 58 is structurally-integral with the top wall 54 of the intermediate portion 34 and meets abruptly therewith. The top wall 58 is wider than the top walls 54 and 56 and the side walls 60 and 62 are arcuate so that they circumvent the upper circular end of the lifter cylinder 26. Thus, the rocker arm 10 can be lower than otherwise and the height of the components above the engine cylinder 14 can be decreased. The side walls 60 and 62 are structurally-integral with the top wall 58 and add significant stiffness to the overall rocker arm body 34. A rounded recess 64 is formed in the top wall 58 and faces downwardly to receive the upper end of the lifter post 12 on which the rocker arm 10 pivots. A lubricating opening 66 formed through the top wall 58 communicates with the recess 64 and can provide a reservoir for oil which can be collected therein and supplied to the mating surfaces of the recess 64 and the end of the lifter post 12.

The second portion 38 of the rocker arm body 34 has an elongate recess or groove 68 (FIGS. 4 and 7) which is of inverted, generally square U-shaped configuration in transverse cross section. The portion 38 has a top or upper wall 70 with two downwardly-extending side walls 72 and 74 which form the groove 68. The groove 68 receives the valve stem 16 with the bottom of the groove contracting the end of the stem to move it longitudinally when the rocker arm pivots.

The intermediate portion 34 of the rocker arm 10 rotatably carries a cam-contacting roller 76 which is exposed at the opening 44 and contacts the overhead cam 22 to cause the rocker arm to pivot on the post 12 when the cam 22 rotates. The cam-contracting roller also enables the overall rocker arm to have a lower height with the combination of the lower profile and compactness enabling the rocker arm to be particularly adaptable for smaller engines and those with lower profiles including lower profile valve trains. The use of the roller also minimizes friction between the cam and the rocker arm which reduces loads and results in better fuel economy or higher performances, as well as reduced wear. The roller 76 is rotatably mounted on an axle 78, preferably with a needle bearing (not shown) therebetween. The axle 78 extends through two aligned circular holes 80 in the side walls 40 and 42 of the intermediate portion 34 with the outer ends of the holes 80 having chamfers 82 to receive flared ends of the axle 78 to hold the axle in position.

Figure 8:
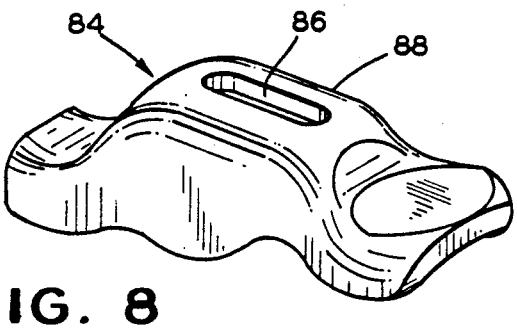
FIG. 8 is a view in perspective of a partially-formed rocker arm body at one stage in its production.
Figure 9:
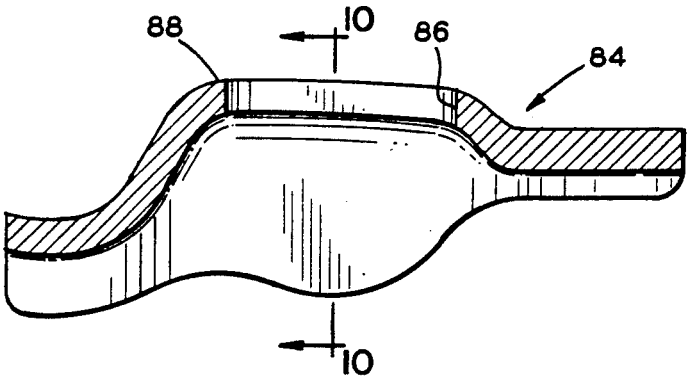
FIG. 9 is a view in longitudinal cross section through the rocker arm body of FIG. 8.
Figure 10:
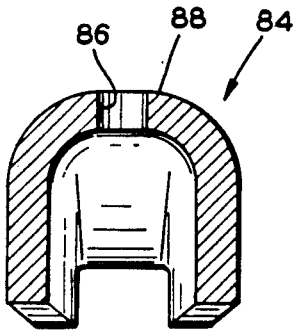
FIG. 10 is a view in transverse cross section taken along the line 10—10 of FIG. 9.

In producing the rocker arm 10, an appropriately shaped blank is partially preformed and the edges then turned further to produce a partially-formed rocker arm body indicated at 84 in FIGS. 8–10. In accordance with the invention, an elongate slot 86 is then formed, preferably by piercing, in a raised intermediate portion 88 of the partially formed body 84. The slot has a width of about one-fifth to one-half of the distance between the side walls, as viewed in FIG. 10, and preferably about one-third of the distance. The slot has a length which is about one-half to seven-eighths of the length of the intermediate portion 88, and preferably about three-fourths of the length.

Figure 11:
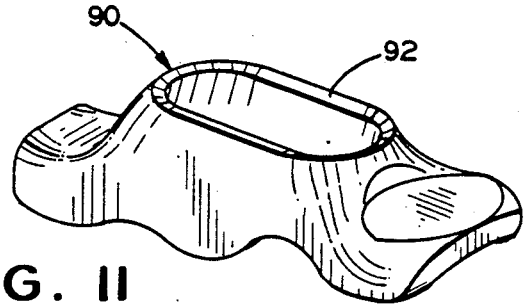
FIG. 11 is a view in perspective of a partially-formed rocker arm body at a later stage in its production.
Figure 12:
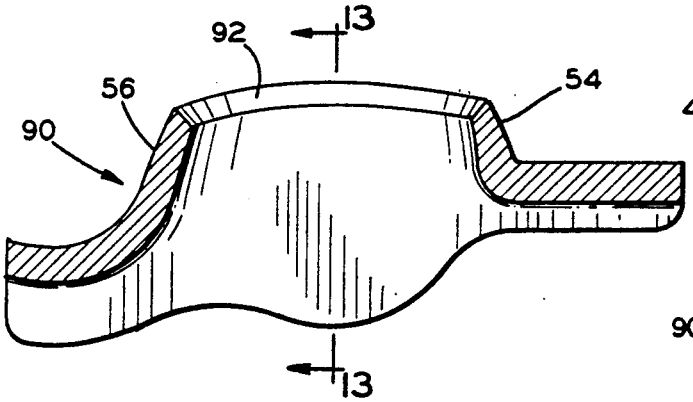
FIG. 12 is a view in longitudinal cross section of the rocker arm body of FIG. 11.
Figure 13:
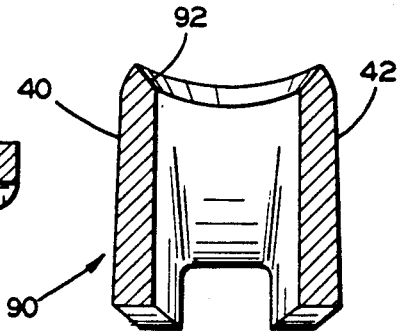
FIG. 13 is a view in transverse cross section taken along the line 13—13 of FIG. 12.

Also in accordance with the invention, the intermediate portion of the body is then pushed or extruded outwardly to form a further partially-formed body 90 of FIGS. 11–13. This step causes an enlargement of the slot 86 primarily in a transverse direction relative to the rocker arm body but also somewhat in a longitudinal direction to produce an opening 92. The opening is similar to the opening 44 in the rocker arm body 32 except that the edges are subsequently back-packed, to blunt the edges and also to square the ends of the opening 92 somewhat. The steeply angled top end walls 54 and 56 of the rocker arm body are also substantially formed at this time. As discussed before, the extrusion of the intermediate portion of the rocker arm body enables the top walls 54 and 56 to be more steeply angled than otherwise so that the arm can be more compact. The extrusion technique also enables the side walls 40 and 42 to be deeper than corresponding side walls of rocker arms heretofore known so that the arm can be stronger and stiffer.

Subsequently, the rocker arm opening is back-packed; the recess 64 is formed and then finished; and the lower surface of the top wall 70 is finished to form a pad for engaging the valve stem 16 at the bottom of the groove 68. The lubricating opening 66 is formed in the recess 64 and the round holes 80 are formed in the side walls 40 and 42 and then chamfered. The roller and axle are then assembled with the body to complete the rocker arm 10 in a conventional manner.

Various modifications of the above-described embodiment of the invention will be apparent to those skilled in the art, and it is to be understood that such modifications can be made without departing from the scope of the invention, if they are within the spirit and the tenor of the accompanying claims.

I claim:

1. A rocker arm of the cam-follower type comprising a one-piece, cold-formed, elongate metal body having an intermediate portion, a first end portion, and a second end portion, said intermediate portion having two substantially parallel side walls, a large, elongate upper opening, and two top walls extending sharply downwardly from ends of said elongate opening, upper edge portions of said parallel side walls near said elongate opening being thinner than lower edge portions thereof and edge portions of said two top walls near said elongate opening being thinner than lower portions thereof, said first end portion having a top wall which is structurally integral with one of said two top walls and two short side walls of arcuate configuration as viewed from below said body, said first end portion top wall having a downwardly-facing recess therein with an opening extending through said first end portion top wall, said arcuate side walls being spaced apart farther than said parallel side walls, said second end portion of said body having a top wall and two side walls with the lower surface of said second end portion top wall being engagable with an upper end of a valve stem, said parallel side walls having aligned holes therein, an axle extending through said holes, and a roller rotatably mounted on said axle and being exposed at said elongate opening for engaging on overhead cam.

2. A rocker arm according to claim 1 wherein said two top walls extend downwardly at angles from sixty degrees to eighty degrees with respect to the horizontal.

3. A rocker arm of the cam-follower type comprising a one-piece, cold-formed, elongate metal body having an intermediate portion, a first end portion, and a second end portion, said intermediate portion having two substantially parallel side walls, a large, elongate upper opening, and two top walls extending sharply downwardly from ends of said elongate opening at angles from sixty degrees to eighty degrees with respect to the horizontal when the rocker arm is in a horizontal position upper edge portions of said parallel side walls near said elongate opening being thinner than lower edge portions thereof and edge portions of said two top walls near said elongate opening being thinner than lower portions thereof, said first end portion having a top wall which is structurally integral with one of said two top walls and having two arcuate side walls, said first end portion top wall having a downwardly-facing recess therein, said second end portion of said body forming a groove with a downwardly-facing surface engagable with an upper end of a valve stem, and a roller rotatably carried by said intermediate portion of said elongate metal body and being exposed at said elongate opening for engaging an overhead cam.

4. A rocker arm according to claim 3 wherein said first end portion top wall is wider than said two top walls.

5. A method of making a cold-formed rocker arm of the cam-follower type having a one-piece metal body of generally inverted U-shaped cross section throughout most of its length, with the body having a top wall and two side walls extending downwardly therefrom and structurally-integral therewith, the body having means at one end portion to receive an end of a lifter post on which the rocker arm can pivot and the body having means at a second end portion for receiving an end of a valve stem, said method comprising forming a metal plate of generally U-shaped configuration in transverse cross section with an intermediate convex portion having a rounded upper wall and two side walls, forming an elongate slot in the intermediate convex portion of the upper wall, and extruding outwardly the intermediate portion to extend the portion, whereby a generally rectangular opening is formed which extends substantially between the side walls and has a length which is less than the longitudinal extent of the convex portion, and sharply angled top walls are formed at the ends of the generally rectangular opening.

6. The method according to claim 5 characterized by forming the elongate slot with a width from about one-fifth to about one-half the distance between the side walls.

7. The method according to claim 5 characterized by forming the elongate slot with a length from about one-half to about seven-eighths of the length of the intermediate portion.

8. The method according to claim 6 characterized by forming the elongate slot with a length from about one-half to about seven-eighths of the length of the intermediate portion.

9. The method according to claim 5 characterized by pushing outwardly the intermediate portion sufficiently to form said top walls at angles of about sixty degrees to about eighty degrees with respect to the horizontal.

* * * * *

UNITED STATES PATENT AND TRADEMARK OFFICE

CERTIFICATE OF CORRECTION

PATENT NO. : 5,048,475

DATED : September 17, 1991

INVENTOR(S) : Jesse V. Mills

It is certified that error appears in the above-identified patent and that said Letters Patent is hereby corrected as shown below:

Column 3, line 59, change "contracting" to --contacting--.

Column 4, line 5, change "performances" to --performance--.

Col. 4, line 32, after "opening" (second occurrence) insert --92--.

Column 5, line 19, claim 1, last line, change "on" to --an--.

Column 5, line 32, claim 3, lines 9-10, after "position" insert --,--.

Signed and Sealed this

Twenty-second Day of December, 1992

*Attest:*

DOUGLAS B. COMER

*Attesting Officer*

*Acting Commissioner of Patents and Trademarks*